US005179887A

United States Patent [19]

Leinen et al.

[11] Patent Number: 5,179,887

[45] Date of Patent: Jan. 19, 1993

[54] CAPTIVE CYLINDER LINEAR SOLENOID VALVE POSITIONER

[75] Inventors: Chris M. Leinen, Houston; Robert E. Schendel, Kingwood, both of Tex.

[73] Assignee: Topworks, Inc., Houston, Tex.

[21] Appl. No.: 679,296

[22] Filed: Apr. 2, 1991

[51] Int. Cl.[5] ..... F15B 13/16

[52] U.S. Cl. ..... 91/387; 91/465; 92/15; 92/23

[58] Field of Search ..... 91/465, 358 R, 363 R, 91/387, 358 A, 41, 42, 44, 45; 92/15, 23; 60/442, 406

[56] References Cited

U.S. PATENT DOCUMENTS

| | | | |
|---|---|---|---|
| 2,172,315 | 9/1939 | Blasig | 91/387 |
| 2,789,543 | 4/1957 | Popowsky | 91/365 |
| 2,800,913 | 7/1957 | Swartwout et al. | 137/84 |
| 2,827,020 | 3/1958 | Cook | 91/387 |
| 2,842,147 | 7/1958 | Markson | 137/85 |
| 2,927,429 | 3/1960 | Carlson | 60/406 |
| 2,969,773 | 1/1961 | Henry | 91/363 R |
| 3,042,005 | 7/1962 | Gray | 91/420 |
| 3,087,468 | 4/1963 | Roberts | 91/165 |
| 3,101,650 | 8/1963 | Blanton | 91/433 |
| 3,313,212 | 4/1967 | Baker et al. | 91/387 |
| 3,396,374 | 8/1968 | Barthel et al. | 340/870.43 |
| 3,446,229 | 5/1969 | Howland | 137/85 |
| 3,664,235 | 5/1972 | Walton | 91/387 |
| 4,383,234 | 5/1983 | Yatsushiro et al. | 335/253 |
| 4,513,782 | 4/1985 | Contartese et al. | 137/625.63 |
| 4,784,039 | 11/1988 | Leinen | 91/387 |
| 4,819,543 | 4/1989 | Leinen | 91/363 R |
| 4,855,659 | 8/1989 | Riensche | 318/645 |

FOREIGN PATENT DOCUMENTS

| | | | |
|---|---|---|---|
| 561759 | 6/1944 | United Kingdom | 91/387 |

*Primary Examiner*—Edward K. Look
*Assistant Examiner*—Hoang Nguyen
*Attorney, Agent, or Firm*—Pravel, Gambrell, Hewitt, Kimball & Krieger

[57] ABSTRACT

A control force input system for a balance beam pneumatic valve positioner which does not allow the controlled apparatus to make a full travel motion when the overall control signal is removed. The control force is transmitted to the balance beam or other force summing bar using a linear solenoid coupled to a control spring coupled to the balance beam. When the motive power control signal is removed from the linear solenoid, the balance beam establishes an equilibrium position based on the existing position of the linear solenoid. The solenoid shaft extends into a captive cylinder. A piston connected to the solenoid shaft is located in the captive cylinder and forms two chambers in the cylinder. A solenoid valve connects a port in each chamber. When the solenoid valve is activated, the piston is free to travel. When the solenoid valve is deactivated, as when the control signal is removed, the piston is held in position, locking the solenoid shaft in position. A variation for use with a current to pressure transducer is detailed.

31 Claims, 5 Drawing Sheets

CAPTIVE CYLINDER LINEAR SOLENOID VALVE POSITIONER

BACKGROUND OF THE INVENTION

1. Field of the Invention

The present invention relates to an apparatus for actuating a process control element using pneumatic and electrical means.

2. Description of the Prior Art

U.S. Pat. Nos. 3,087,468 and 3,313,212 disclosed pneumatic and magnetic-pneumatic control systems for actuating valves and other apparatus. Both patents utilized pneumatic relays and a balance beam assembly to supply air pressure to a piston located in a cylinder. Unbalancing the beam caused air pressure to be supplied to one side of the piston and removed from the other side of the piston so that the piston moved. The piston was coupled to the balance beam by a spring so that as the piston moved, the balance beam received a force in a counterbalancing direction, forming the feedback necessary to allow the piston to balance at a given location. This movement of the piston and a shaft connected to the piston caused the valve to move as requested by a control input.

The initial imbalance or control signal was provided in U.S. Pat. No. 3,087,468 by a pneumatic bellows assembly appropriately coupled to the beam so that expanding or contracting the bellows caused the balance beam to pivot. The beam became balanced when the piston had moved sufficiently so that the force provided by the spring connected to the piston balanced the force provided by the bellows.

In U.S. Pat. No. 3,313,212 the imbalancing force was provided by a magnetic means using a permanent magnet attached to the balance beam and a coil located near the permanent magnet so that a current in the coil caused a magnetic force between the permanent magnet and the coil. This magnetic force caused the beam to pivot, with balance being restored when the piston spring force balanced the magnetic force being applied.

While the systems performed adequately under ordinary operating conditions, when the control source was removed, in U.S. Pat. No. 3,087,468, when the instrument supply air to the bellows was removed or in U.S. Pat. No. 3,313,212, when the coil current was removed, the actuators caused the piston to travel to full stroke in either the open or closed direction, depending upon configuration and pneumatic connections. This was an undesirable situation because this resulted in reduced control of the system, often when control was critical.

U.S. Pat. No. 4,784,039 disclosed a system which improved on the designs of U.S. Pat. Nos. 3,087,468 and 3,313,212 and similar designs. A motor was connected to a drive unit, which in turn was connected to a control spring, which provided the imbalance or control force. Driving the motor in either direction changed the length of the control spring, hence, the control force, causing the positioner setting to change. When the drive signal was removed from the motor, the motor stopped turning and the control force was set at that point. While this did prevent full travel of the actuator if the control signal were removed, the system required bipolar or reversible drive signals to the motor, somewhat complicating controller design and making use of conventional 4–20 mA electrical control signals difficult.

SUMMARY OF THE INVENTION

The present invention provides an apparatus whereby the termination or removal of the control input or signal does not result in the piston making a full travel motion but causes the piston to remain at the balanced location set prior to the termination of the control signal. In the present invention, the imbalancing or control force is provided by a control spring connected to the solenoid shaft of a linear solenoid driven by a 4–20 mA signal. Changing the current level to the solenoid changes the position of the solenoid shaft and thus the compression or extension of the control spring.

A captive cylinder is also connected to the linear solenoid. A portion of the solenoid shaft extends out the top of the linear solenoid and into a closed cylinder. A piston is connected to the shaft to divide the cylinder into two chambers. A solenoid valve connects a port in each chamber. The solenoid valve receives a control signal, preferably the same signal as the linear solenoid. When the control signal is above a predetermined value, the solenoid valve is activated and the two ports connected, so that the fluid in the cylinders, either air or a more viscous fluid, is free to travel between chambers, thus allowing the piston to move in the cylinder. When the control signal to the solenoid valve is below the predetermined value, the solenoid valve is closed. This blocks fluid transfer and thus locks the piston in place. With the piston thus locked, the solenoid shaft is also fixed in position.

This means that the valve or other device being actuated is maintained at the position selected prior to termination of the driving signal to the solenoid, in many cases a more desirable condition than either the fully open or fully closed positions. Such operation thus avoids the problem of completely closing down the fluid flow to an operating system connected therewith, or alternatively supplying excessive fluid flow in the fully open position, either condition of which can be disastrous, especially if the correction is delayed for a substantial period of time. By leaving the system operating at the condition it is in when the malfunction occurs, both of the two extreme conditions are avoided, and normally, there would be no adverse effect under such condition.

DESCRIPTION OF THE ALTERNATE EMBODIMENTS

Figure 1:
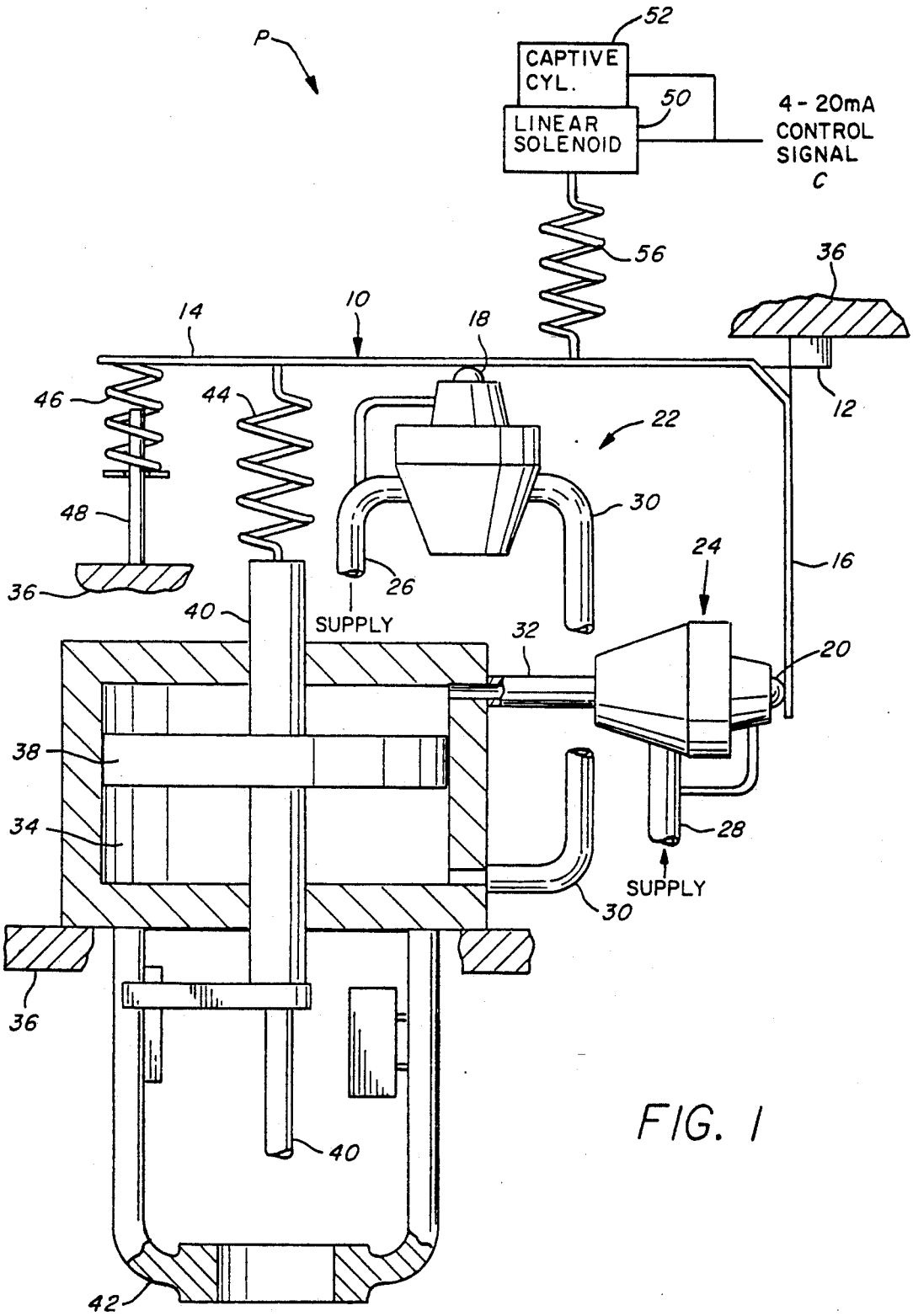
FIG. 1 is a schematic view of a valve positioner according to the present invention.

Referring to FIG. 1, the letter P generally refers to an electrical and pneumatic valve positioner according to the present invention. The positioner P includes a balance beam 10 which pivots at a pivot element 12 and has two arms 14, 16. A pair of pneumatic relays 22, 24 are used in conjunction with the balance beam 10 as the relays used control the air supply used to drive a piston 38 located in a cylinder 34. This piston 38 provides the motion used in actuating the operating device, which is commonly a valve.

The pneumatic relays 22, 24 receive a supply of air through supply ports 26, 28. The pneumatic relays 22, 24 have nozzles 18, 20 which contact the balance beam 10 to control the supply of air to the cylinder 34. The relays 22, 24 have an output port 30, 32 which can be connected either to the pneumatic supply 26, 28 or to a vent port depending upon the position of the balance beam 10 in relation to the nozzles 18, 20. The relays are connected to two ports of the cylinder 34, one relay 22 having its output port 30 connected below the piston 38 and the other relay 24 having its output port 32 connected above the piston 38.

In one preferred embodiment, if the balance beam 10 were to be located away from the nozzle 18 of pneumatic relay 22, the output port 30 would be connected to the vent. The location of the other relay 24 is such that under these conditions its nozzle 20 would be closed by the balance beam arm 16 and the air supply 28 would be connected to the output port 32. In this way the piston travels downwardly in the cylinder 34 because of a positive pressure above the piston 38 and a vent connection below the piston 38. A shaft 40 connected to the piston 38 causes the attached valve or other mechanism to travel. This travel of the piston 38 and the shaft 40 is fed back to the balance beam 10 by means of a range spring 44 connected to the shaft 40. As the piston 38 travels downwardly, the range spring 44 is extended and therefore exerts a force on the balance beam causing the balance beam arm 14 to approach the relay nozzle 18 and the balance beam arm 16 to move away from the nozzle 20 of the other relay 24. As the nozzle 18 is closed off, and the other nozzle 20 is opened up, the venting of the output port 30 ceases, the pressure supply to output port 32 stops, and the piston 38 stops traveling.

A zero set condition, wherein the piston 38 is aligned in the cylinder 34 at the desired zero spring 46 attached to a shaft 48 which is in turn attached to the fixed structure 36 of the positioner P. Appropriately adjusting the zero spring 46 on the shaft 48 sets the zero position of the piston 38 as desired, generally at a central position.

When the system is in equilibrium at a given position, a control input is used to cause the piston 38 to move as desired. The control input is provided by the combination of a linear solenoid 50 which is connected via a solenoid shaft 54 to a control spring 56. The control spring 56 is attached to the balance beam 10. A captive cylinder 52, to be described in greater detail, is also connected to the linear solenoid 50. When the linear solenoid 50 is energized by a differing signal, the control spring 56 is compressed or extended, thus applying a force to the balance beam 10 to upset the equilibrium and causing the piston 38 to move in the desired direction. Energizing the linear solenoid 50 causes the solenoid shaft 54 to move to a position based on the level of an applied control signal C, preferably a conventional 4–20 mA signal but alternatively any signal which provides for movement of the solenoid shaft 54. Thus, varying the control signal C causes a varying control force to be applied to the control spring 56 and thus to the balance beam 10.

Figure 3:
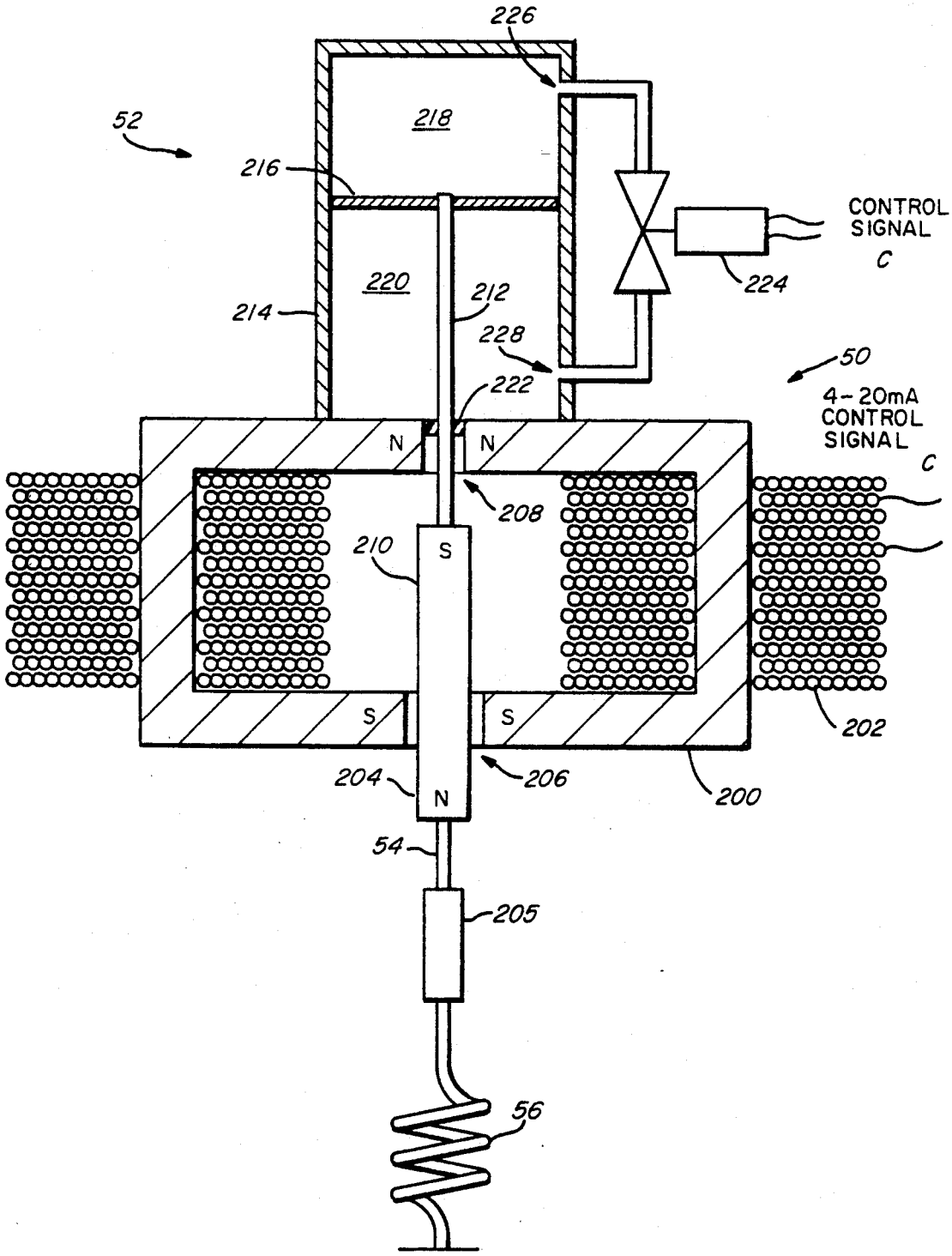
FIG. 3 is a schematic diagram in cross-section of a linear solenoid, captive cylinder and control spring according to the present invention.

Referring to FIG. 3, an enlarged cross-sectional view of the linear solenoid 50 and the captive cylinder 52 is illustrated. The linear solenoid 50 includes an iron or steel core 200 around which is wrapped a coil 202. The coil 202 is formed by a plurality of windings of wire and is connected to the 4–20 mA control signal C. The bottom surface of the core 200 preferably includes a circular hole 206, while the upper surface includes a circular hole 208. A solenoid slug 204 is preferably cylindrical and includes a first end 210 which is preferably polarized by a permanent magnetic field to attract to the upper surface of the core 200, while the second end of the slug 204 is polarized to a field which will be attracted to the lower portion of the slug 200. Thus, when the solenoid 50 is energized, the slug 204 is attracted to the core 200 in an upwardly direction, thus causing the solenoid shaft 54 which is connected to the lower end of the slug 204 to move, which in turn provides movement of the control spring 56. Preferably the position of the slug 204 varies linearly with the change in the control signal C, but varying relationships can be developed by variations in the design of the solenoid 50. The illustrated linear solenoid is a simplified variation and alternative designs of linear solenoids could be utilized. Further, other elements having a shaft whose position is controlled by an electrical signal and with a produced magnetic field could be utilized.

The shaft 54 may be connected to the control spring 56 by means of a turnbuckle 205 or other means for adjusting the relationship between the shaft 54 and the control spring 56 to allow for additional zeroing or calibrating capabilities. The solenoid 50 also includes a second shaft 212 exiting the top of the linear solenoid 50 through the upper hole 208 and connected to the slug 204. This shaft 212 enters the captive cylinder 52.

The captive cylinder 52 includes a cylindrical housing 214. A piston 216 is located inside the housing 214 and forms upper and lower chambers 218 and 220. The piston 216 is connected to the upper shaft 212. A seal 222 is located in the upper hole 208 around the shaft 212 so that fluid is contained in the lower chamber 220. A solenoid valve 224 is connected to a port 226 in the upper chamber 218 and a port 228 in the lower chamber 220. When the solenoid valve 224 is activated, fluid is free to travel between the upper and lower chambers 218 and 220. The fluid contained in the captive cylinder 52 can be air for simplicity or a more viscous fluid a dampening action is desired. When the solenoid valve 224 is activated, the piston 216 is free to move in the housing 214, causing fluid to move between the chambers 218 and 220. If the fluid is relatively viscous and a flow restriction is present in the bypass path developed by the linear solenoid 224, a dampening or dashpot effect can be developed.

If the solenoid valve 224 is not activated, the valve 224 is closed and the fluid is trapped in the upper and lower chambers 218 and 220. The piston 216 can then only move based on the compressibility of the fluid. If a relatively incompressible fluid is utilized, the piston 216 will travel very little. In a steady state condition, after transients have settled out, the piston 216 will be positioned essentially where it was when the solenoid valve 224 was deenergized, assuming the forces exerted by the control spring 56 through the linear solenoid 50 are minor when compared to the required fluid compressibility forces. Thus the piston 216 is effectively locked at the position where the solenoid valve 224 was deenergized. The positioner P balances out based on this control force as provided through the shaft 212, the slug 204, the shaft 54 and the control spring 56. When the solenoid valve 224 is reactivated, the slug 204 and thus the shaft 212 is free to move as desired based on the control signal C because fluid can how flow between the chambers 218 and 220.

The illustrated solenoid valve 224 connects the ports 226 and 228, but the solenoid valve 224 could be designed to vent both ports 226 and 228 when energized and seal the ports 226 and 228 when deenergized. This variation may reduce the dampening possibilities but is otherwise similar to the illustrated arrangement.

The solenoid valve 224 preferably receives the control signal C provided to the linear solenoid 50. The solenoid valve 224 is designed so that when a signal above a predetermined minimum or zero value is provided, such as 4 mA, the solenoid valve 224 is energized. When a signal below this limit or no signal is provided, the solenoid valve 224 is deenergized, thus locking the piston 216 in place. By utilizing the same control signal C and setting the energization limit at the zero value, then when a valid control signal is being provided to the linear solenoid 50, the linear solenoid 50 is free to provide varying control forces but if the provided signal is below design limits, the linear solenoid 50 is locked.

A separate control signal C' (FIG. 2) can be provided to the solenoid valve 224 if desired to allow greater flexibility in active and locked control.

Figure 2:
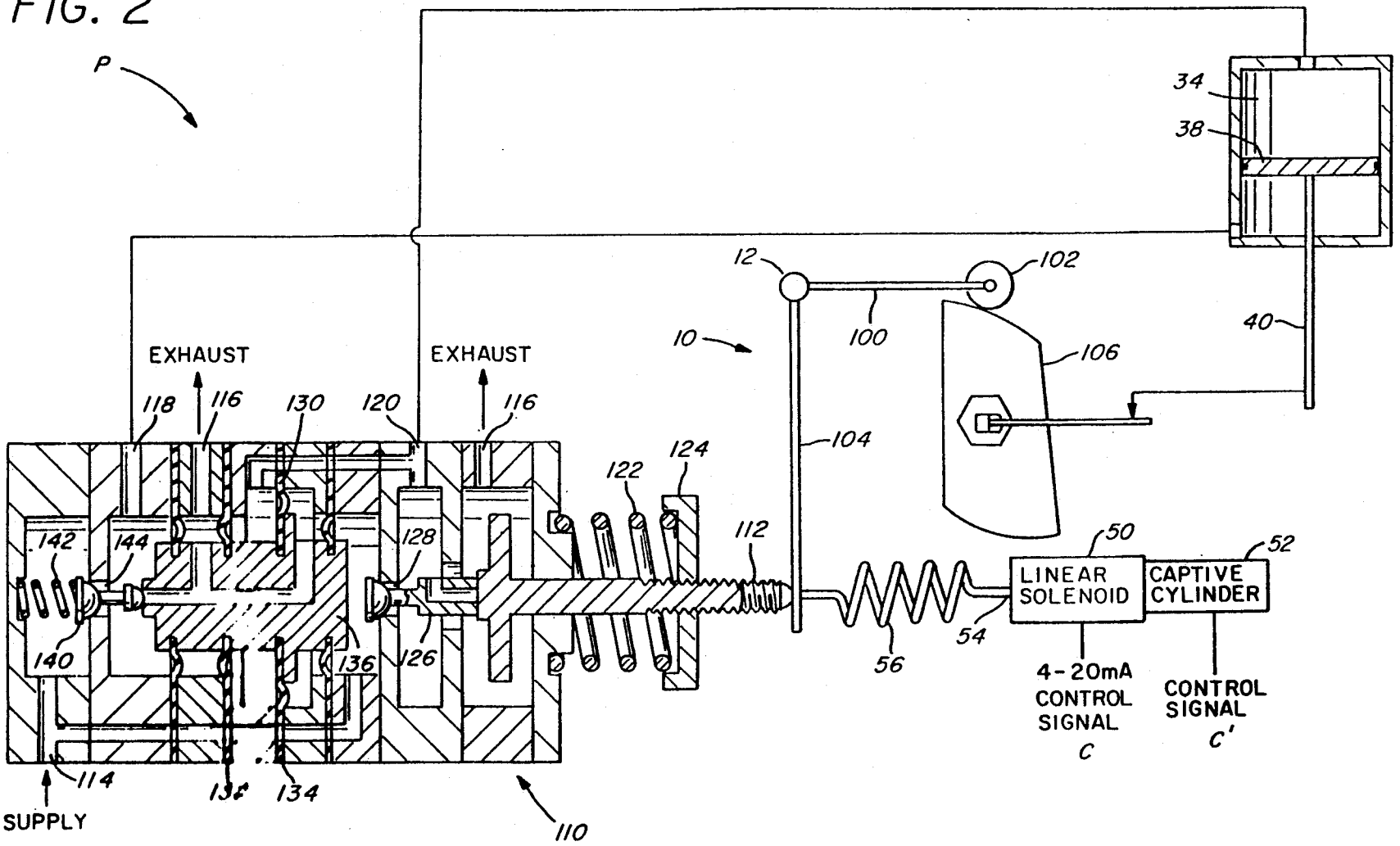
FIG. 2 is a schematic illustration of an alternative valve positioner according to the present invention.

An alternate embodiment of the valve positioner P is shown in FIG. 2. In this embodiment the linear solenoid 50, the captive cylinder 52 and the control spring 56 are connected to a balance beam 10 to provide the control force and control input. The balance beam 10 has two arms, a first arm 100 which has a wheel 102 mounted at one end. The other arm 104 of the balance beam 10 is flexible and is described as a cantilever range spring. This arm 104 therefore replaces both the arm 14 and the range spring 44 of the embodiment shown in FIG. 1, the wheel 102 tracks a cam 106 which is coupled to the piston shaft 40. The cam 106 allows the positional input of the piston 38 to be fed back to the balance beam 10 using various ratios, either linear or accelerated ratios as described, for adjusting the sensitivity of the positioner P.

A relay block 110 is coupled to the cantilever range spring 104 by means of a follower 112. The relay block 110 is supplied with air pressure to the supply port 114 and has exhaust ports 116 and output ports 118 and 120. The output ports 118, 120 are connected to the upper and lower portions of a cylinder 34 as desired for direct action or reverse action of the positioner P. A zero set spring 122 and a zero set nut 124 are provided to adjust the zero position of the piston 38.

Operation of the positioner P shown in FIG. 2 is as follows. The linear solenoid 50 is energized to a desired level so that the control spring 56 is compressed. This causes the follower 112 to move a direct pilot valve 126 so that a direct pilot port 128 is opened, allowing pressure to be transmitted from the supply to the outlet port 120 in turn pressurizes a central chamber 130 located between two diaphragms 132 and 134. The pressure in the central chamber 130 moves a reverse pilot control block 136 away from a reverse pilot valve 140. This movement of the control block 136 connects the outlet port 118 to the exhaust port 116, reducing pressure on the opposite side of the piston 38 so that the piston 38 can travel. The travel of the piston 38 causes the shaft 40 to move, which in turn is coupled to the cam 106, which moves the balance beam 10 until an equilibrium condition is met and the piston 38 is in the desired location.

If the piston 38 is desired to be moved in the opposition direction from the previous example, the linear solenoid 50 is energized to a differing level and the control spring 56 is extended so that the balance beam 10 is moved away from the follower 112. This movement of the balance beam 10 causes the follower 112 to move away from the direct pilot valve 126 which in turn couples the outlet port 120 to the exhaust port 116 so that a portion of the cylinder 34 is being vented. The exhaust port 116 is also coupled to the central chamber 130 so that a reduced pressure appears in the central chamber 130. This reduced pressure causes the reverse pilot control block 136 to exert a force on the reverse pilot valve 140 and compress a reverse pilot spring 142. The movement of the reverse pilot valve 140 opens a reverse pilot port 144, thereby allowing the air supply port 114 to be connected to the outlet port 118. In this way, supply pressure is connected to the opposite side of the piston 38 and the piston 38 therefore travels inside the cylinder 34. This travel of the piston 38 continues until the balance beam 10 establishes an equilibrium condition.

Figure 4:
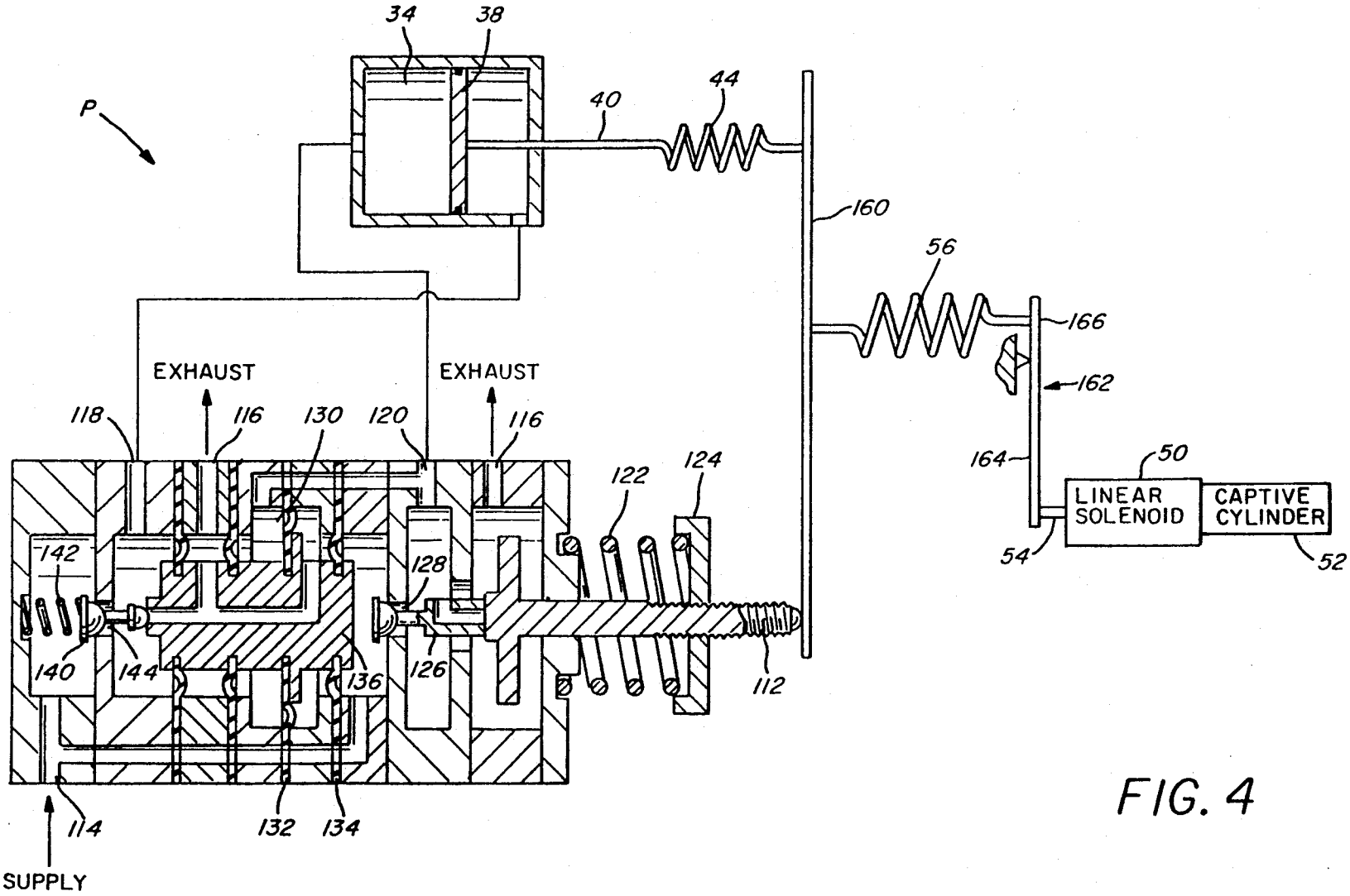
FIG. 4 is a schematic illustration of an alternative positioner according to the present invention.

Another alternate embodiment of the positioner P is shown in FIG. 4. In this embodiment the balance beam 10 has been replaced by a sliding bar 160. The sliding bar 160 freely slides transversely but does not pivot, so that the sliding bar 160 is a summing junction for the forces supplied by the range spring 44, the control spring 56 and the zero set spring 22. As the control spring 56 is extended, the bar 160 moves away from the follower 112 causing the outlet port 120 to be coupled to the exhaust 116 and the other outlet port 118 to be coupled to the pneumatic supply 114, in a fashion similar to that of the embodiment shown in FIG. 2. This connection of the outlet ports 118, 120 causes the piston 38 to travel to extend the range spring 44. The piston 38 travels until the forces supplied by the various springs are balanced and the positioner P is in an equilibrium position.

In the previous embodiments the solenoid shaft 54 has been directly connected to the control spring 56. An alternative arrangement is shown in FIG. 4. In some cases the force required to be applied by the linear solenoid 50 may be quite high. In those cases a balance beam 162 may be used for force multiplication. The solenoid shaft 54 is connected to the longer arm or side 164 of the balance beam 162, with the control spring connected to the shorter side 166. In this manner a greater force can be applied by trading off for distance traveled.

It can be seen that should the control signal C to the linear solenoid 50 be removed, in any embodiment, the positioner P would only reach the equilibrium point which was established by the linear solenoid 50 prior to its deenergization. In so doing, the piston 38 would not travel to a full travel position in the cylinder 34, but would remain at the equilibrium condition set by the position of the linear solenoid 50.

This characteristic of remaining at the current position is more desirable in many control situations because this eliminates the addition of an additional error signal into the environment and thereby lessens the required responses. Maintaining the valve positioner at its current position also allows a partially operational condition to occur. For example, if the valve positioner is operating a valve on a gas pipeline spur which feeds a city and the positioner loses the control signal, a full travel condition would either shut off the gas to the city, or increase the flow to the city, thereby disrupting overall pressure and flow conditions on the pipeline. By remaining in the current position, the valve positioner of the present invention prevents either of these developments and keeps gas flow and pressure at the rate previously used, resulting in fewer problems for both the city and the pipeline operators.

Alternate embodiments of the positioner P of the present invention can be used with piston and spring actuator assemblies, vane actuators, pneumatic motors, or other actuators as appreciated by those skilled in the art.

An embodiment of the positioner P used in conjunction with a piston and spring actuator has only a single outlet port which is coupled to the pneumatic portion of the cylinder. Pneumatic pressure is applied to only one side of the piston in the cylinder, with the spring providing the opposing force. By coupling the output port of a pneumatic supply the pressure in the cylinder increases, moving the piston against the resisting force of the spring. When the output port is coupled to a vent, the pressure in the cylinder is reduced and the piston is moved by the spring.

An embodiment of the positioner P used in conjunction with a vane actuator is similar to the above piston in cylinder examples, except that the vane pivots instead of the piston traveling in cylinder. The vane is appropriately coupled to the positioner P to provide positional information.

Figure 5:
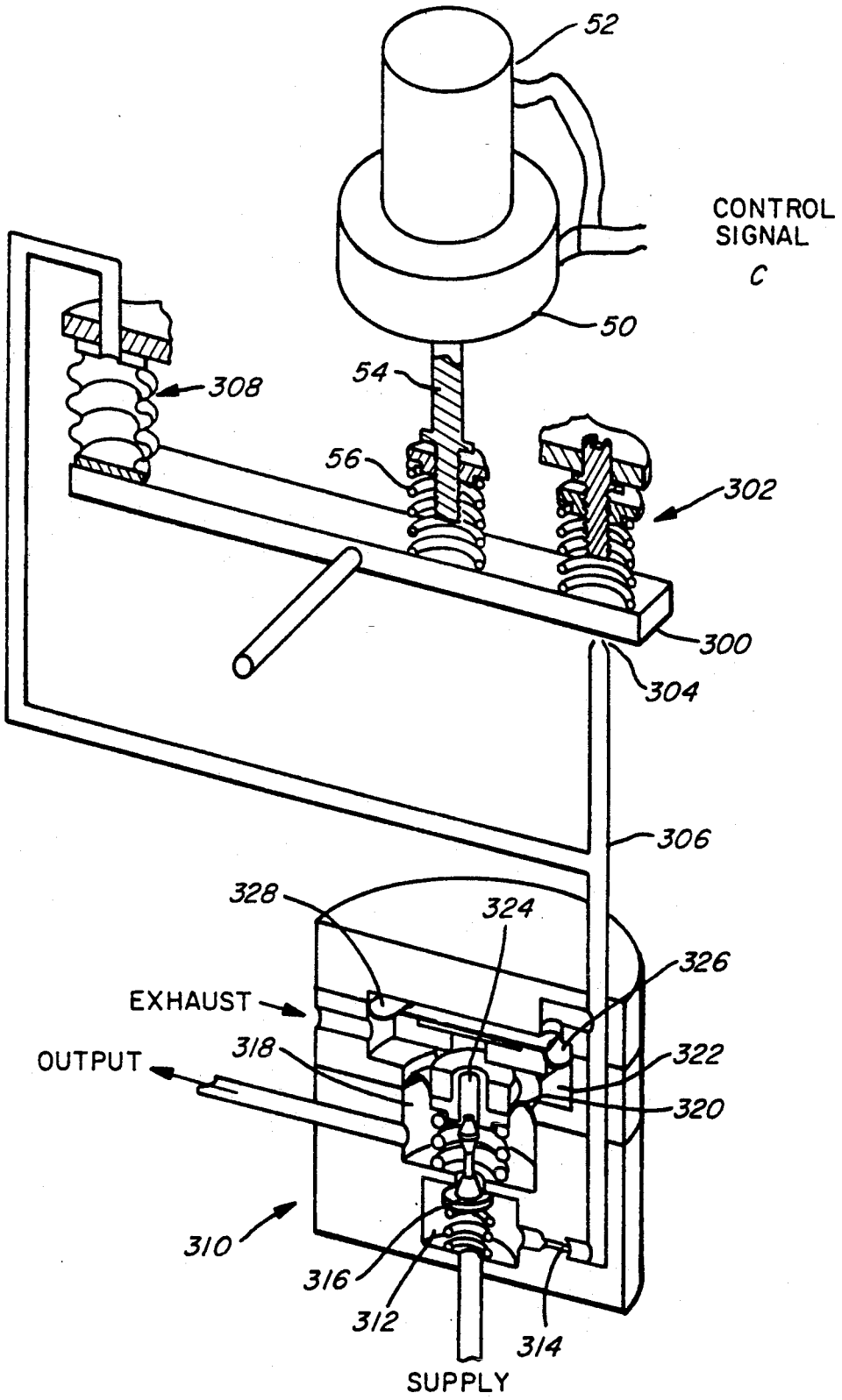
FIG. 5 is a schematic illustration of a current to pressure transducer according to the present invention.

While a linear solenoid associated with a positioner is shown in the illustrated embodiments of FIGS. 1–4, the basic principal of the captive cylinder locking a shaft when the device is deenergized and freeing the shaft when the control source is energized can be applied to control elements commonly used in areas other than positioners. One example is a current to pressure transducer as illustrated in FIG. 5. A balance beam or torque bar 300 is used for force balancing and summing. The linear solenoid 50 with a connected captive cylinder 52 is coupled to the balance beam 300 through the control spring 56. A zero adjust spring assembly 302 also provides a force on the balance beam 300 for calibration purposes. A nozzle 304 is located under and near the balance beam 300, with the opening or closing of the nozzle providing a pneumatic signal. The pneumatic supply 306 to the nozzle 304 is also connected to a bellows assembly 308, which provides a feedback force to the balance beam 300.

The nozzle supply 306 is provided from a relay 310. A source supply is provided to a receiving chamber 312 in the relay 310. A fixed port 314 from this chamber 312 provides the nozzle supply 306. A valve plug 316 is located in an opening in the relay 310 between the receiving chamber 312 and an output chamber 318. An exhaust control diaphragm 320 separates the output chamber 318 from an exhaust chamber 322. The diaphragm 320 includes a control port 324 which interacts with the valve plug 316 to allow air to be exhausted rather than output. A control diaphragm 326 separates the exhaust chamber 322 from an upper chamber 328. The upper chamber 328 is ported to the nozzle supply 306. The control diaphragm 326 is connected to the control port 324 to cause the central port 324 to move in relation to the valve plug 316 as the nozzle supply 306 pressure varies.

Operation of the embodiment of FIG. 5 is as follows. The linear solenoid 50 is activated to reduce the force applied by the control spring 56. This causes the balance beam 300 to move away from the nozzle 304. As the nozzle 304 is opened, the pressure in the pneumatic supply 306 decreases as more pressure is exhausted through the nozzle 304 than can be provided to the pneumatic supply 306 through the fixed port 314. This pressure drop in the pneumatic supply 306 reduces the force being applied to the balance beam 300 by the bellows 308. The pressure drop in the pneumatic supply 306 continues until the force provided by the bellows 308 matches the force of the control spring 56 and the balance beam 300 is again balanced.

As the pressure is dropped in the pneumatic supply 306, the control port 324 moves upward, away from the valve plug 316, because the pressure over the control diaphragm 326 is reduced. This allows pressure to be vented from the output to the exhaust, reducing the output pressure. When the balance beam 300 returns to its balanced state, the control port 324 returns to its downward position, the path between the output and the exhaust being closed by the valve plug 316.

When the linear solenoid 50 is activated to increase the force applied by the control spring 56, the balance beam 300 moves toward the nozzle 304. In this instance the pressure in the pneumatic supply 306 increases as more pressure is being supplied through the fixed port 314 than can be exhausted by the nozzle 304. This increased pressure in the pneumatic supply 306 increases the force provided by the bellows 308. This increased force ultimately balances the increased force provided by the control spring 56. So the balance beam 300 returns to its balanced state.

As the pressure in the pneumatic supply 306 is increased, the control port 324 is forced downward, as the pressure above the control diaphragm 326 increases. The downward movement of the control port 324 causes the valve plug 316 to move downward, allowing pressure to be provided from the supply to the output. When the balance beam 300 returns to its balanced state, the control port 324 and the valve plug 316 both return upward, with the path between the supply and output being closed.

Thus changing the current in the control signal C to the linear solenoid 50 changes the pressure supplied at the output of the relay 310. Again, if the control signal C is removed, the captive cylinder 52 fixes the position of the solenoid 50 and thus the force provided by the control spring 56. Equilibrium of the balance beam 300 is established at that point, not at a full or zero pressure condition.

Similarly, the captive cylinder principal could be utilized in various designs which utilize a pivoting bar which is pivoted by the action of a varying field of an electromagnet as shown in U.S. Pat. No. 3,042,005 or 3,446,229.

The foregoing disclosure and description of the invention are illustrative and explanatory thereof, and various changes in the size, shape and materials as well as in the details of the illustrated construction may be made without departing from the spirit of the invention, all such changes being contemplated to fall within the scope of the appended claims.

We claim:

1. A control element positioning apparatus, comprising:

a balance beam, said balance beam being coupled to a pivot element;

a pair of pneumatic force balance elements each having an air nozzle, the nozzle of each force balance element being disposed adjacent to said balance beam and positioned whereby movement of said balance beam towards one nozzle moves said balance beam away from the other nozzle, each of said force balance elements having a pneumatic output element;

a cylinder, said cylinder having a piston disposed therein, said piston being coupled to a shaft;

each of said pneumatic output elements being coupled to an end of said cylinder;

a range spring coupled between said shaft and said balance beam;

a control spring having two ends, the first end coupled to said balance beam;

means having a shaft and electrical signal inputs for varying the position of said shaft in proportion to a signal received at said electrical signal inputs, said shaft being coupled to the second end of said control spring and extending from said position varying means;

a closed cylinder having an aperture for receiving said shaft extending from said position varying means, a piston connected to said shaft dividing said cylinder in first and second chambers, a fluid contained in said cylinder and a port in each of said first and second chambers; and an electrically operated valve connected to said ports of said first and second captive cylinder chambers and having electrical signal inputs for receiving an electrical control signal said valve being activated to allow transfer through said ports of said first and second chambers and blocking fluid transfer through said ports when deactivated.

2. The apparatus of claim 1, further comprising:

a zero spring coupled to said balance beam for allowing a zero reference equilibrium position to be established.

3. The apparatus of claim 1, wherein said position varying means includes a linear solenoid.

4. The apparatus of claim 1, wherein said electrical signal inputs of said position varying means and said electrical valve are connected together.

5. The apparatus of claim 1, wherein said electrical valve connects said first and second ports and includes a flow restrictor to limit flow of said fluid between said ports.

6. The apparatus of claim wherein said electrical valve means is activated when an electrical signal above a predetermined magnitude is provided.

7. A control element positioning apparatus for positioning a piston in a cylinder, the cylinder having inlet ports at both ends and the piston being coupled to a shaft and the apparatus being coupled to a pneumatic supply and an exhaust, comprising:

a balance beam, said balance beam being coupled to a pivot element and said balance beam being coupled to the shaft;

a pneumatic force balance element having pneumatic output elements and being coupled to said balance beam so that when said balance beam moves in a first direction a first pneumatic output element is coupled to a pneumatic supply and a second pneumatic output element is coupled to an exhaust and when said balance beam moves in a second direction, the first pneumatic output element is coupled to an exhaust and the second pneumatic output element is coupled to a pneumatic supply;

each of said pneumatic output elements being adapted to be coupled to an end of the cylinder;

a control spring having two ends, the first end coupled to said balance beam;

means having a shaft and electrical signal inputs for varying the position of said shaft in proportion to a signal received at said electrical signal inputs, said shaft being coupled to the second end of said control spring and extending from said position varying means;

a closed cylinder having an aperture for receiving said shaft extending from said position varying means, a piston connected to said shaft dividing said cylinder in first and second chambers, a fluid contained in said cylinder and a port in each of said first and second chambers; and an electrically operated valve connected to said ports of said first and second captive cylinder chambers and having electrical signal inputs for receiving an electrical control signal said valve being activated to allow fluid transfer through said ports of said first and second chambers and blocking fluid transfer through said ports when deactivated.

8. The apparatus of claim 7, further comprising:

a range spring for providing a force indicative of the position of the piston in the cylinder, said range spring coupling said balance beam to the shaft.

9. The apparatus of claim 7, wherein said balance beam includes a range spring for providing a force indicative of the position of the piston on the cylinder.

10. The apparatus of claim 9, further comprising:

a zero spring coupled to said balance beam for allowing a zero reference equilibrium position to be established.

11. The apparatus of claim 7, wherein said position varying means includes a linear solenoid.

12. The apparatus of claim 7, wherein said electrical signal inputs of said position varying means and said electrical valve are connected together.

13. The apparatus of claim 7, wherein said electrical valve connects said first and second ports and includes a flow restrictor to limit flow of said fluid between said ports.

14. The apparatus of claim 7, wherein said electrical valve means is activated when an electrical signal above a predetermined magnitude is provided.

15. A positioning apparatus for positioning an actuator; the actuator being adapted to move bidirectionally, being responsive to pneumatic pressures and providing means for indicating the position of the actuator; and the apparatus being coupled to a pneumatic pressure source and a pneumatic pressure vent, comprising:

means for summing a plurality of applied forces and being adapted for motion in response to an imbalance of the applied forces;

actuator bias means for providing a force indicative of the actuator position, said actuator bias means being coupled to the actuator position indication means and coupled to said summing means;

control bias means for providing a force indicative of the desired actuator position, said control bias means being coupled to said summing means and having an input for receiving a positional signal;

means having a shaft and electrical signal inputs for varying the position of said shaft in proportion to a signal received at said electrical signal inputs, said shaft being coupled to the second end of said control spring and extending from said position varying means;

a closed cylinder having an aperture for receiving said shaft extending from said position varying means, a piston connected to said shaft dividing said cylinder in first and second chambers, a fluid contained in said cylinder and a port in each of said first and second chambers;

an electrically operated valve connected to said ports of said first and second captive cylinder chambers and having electrical signal inputs for receiving an electrical control signal said valve being activated to allow fluid transfer through said ports of said first and second chambers and blocking fluid transfer through said ports when deactivated; and pneumatic pressure control means for coupling the pneumatic pressure source and the pneumatic pressure vent to the actuator, said pressure control means being coupled to said summing means, to the actuator to the pneumatic pressure source and to the pneumatic pressure vent, so that when said summing means moves in a first direction vent are coupled to the actuator to cause the actuator to move in one direction and when the summing means moves in a second direction the pneumatic pressure source and the pneumatic pressure vent are coupled to the actuator to cause the actuator to move in an opposite direction.

16. The apparatus of claim 15, further comprising:

zero set bias means for providing a force to set the equilibrium position of said summing means at a selected actuator position, said zero set bias means being coupled to said summing means.

17. The apparatus of claim 16, wherein said summing means includes a balance beam.

18. The apparatus of claim 17, wherein said pneumatic pressure control means includes first and second pneumatic output means adapted so that when said first output means is coupled to the pneumatic pressure source, said second output means is coupled to the pneumatic pressure vent and when said first output means is coupled to the pneumatic pressure vent, said second output means is coupled to the pneumatic pressure source.

19. The apparatus of claim 17, wherein said balance beam has two arms and said actuator bias means includes one of said balance beam arms.

20. The apparatus of claim 19, further comprising:

zero set bias means for providing a force to set the equilibrium position of said summing means at a selected actuator position, said zero set bias means being coupled to said summing means.

21. The apparatus of claim 15, wherein said electrical signal inputs of said position varying means and said electrical valve are connected together.

22. The apparatus of claim 15, wherein said electrical valve connects said first and second ports and includes a flow restrictor to limit flow of said fluid between said ports.

23. The apparatus of claim 15, wherein said electrical valve means is activated when an electrical signal above a predetermined magnitude is provided.

24. The apparatus of claim 16, wherein said pneumatic pressure control means includes first and second pneumatic output means adapted so that when said first output means is coupled to the pneumatic pressure source, said second output means is coupled to the pneumatic pressure vent and when said first output means is coupled to the pneumatic pressure vent, said second output means is coupled to the pneumatic pressure source.

25. An apparatus for providing a pneumatic pressure output, the apparatus being coupled to a pneumatic pressure source and a pneumatic pressure vent, comprising:

means for summing a plurality of applied forces and being adapted for motion in response to an imbalance of the applied forces;

means for providing a control pressure having a port coupled to said summing means, said control pressure varying based on the location of said summing means in relation to said control pressure port;

bias means for providing a force indicative of said control pressure, said bias means being coupled to said control pressure means and coupled to said summing means;

control bias means for providing a force indicative of the desired output pressure, said control bias means being coupled to said summing means and having an input for receiving a positional signal;

means having a shaft and electrical signal inputs for varying the position of said shaft in proportion to a signal received at said electrical signal inputs, said shaft being coupled to said control bias means positional signal input and extending from said position varying means;

a closed cylinder having an aperture for receiving said shaft extending from said position varying means, a piston connected to said shaft dividing said cylinder in first and second chambers, a fluid contained in said cylinder and a port in each of said first and second chambers;

an electrically operated valve connected to said ports of said first and second captive cylinder chambers and having electrical signal inputs for receiving an electrical control signal said valve being activated to allow fluid through between said closed cylinder ports of said first and second chambers and blocking fluid transfer through said closed cylinder ports when deactivated; and pneumatic pressure control means for coupling the pneumatic pressure source and the pneumatic pressure vent to the apparatus, said pressure control means being coupled to the control pressure means, to the pneumatic pressure source and to the pneumatic pressure vent, and providing the pneumatic pressure output, so that when said summing means moves in a first direction a greater pressure is applied to the pressure output and a lesser pressure is applied to said pressure vent and when the summing means moves in a second direction a lesser pressure is applied to the pressure output and a greater pressure is applied to said pressure vent.

26. The apparatus of claim 25, further comprising:

zero set bias means for providing a force to set the equilibrium position of said summing means at a selected output pressure, said zero set bias means being coupled to said summing means.

27. The apparatus of claim 26, wherein said summing means includes a balance beam.

28. The apparatus of claim 25, wherein said position varying means is a linear solenoid.

29. The apparatus of claim 25, wherein said electrical signal inputs of said position varying means and said electrical valve are connected together.

30. The apparatus of claim 25, wherein said electrical valve connects said first and second closed cylinder ports and includes a flow restrictor to limit flow of said fluid between said closed cylinder ports.

31. The apparatus of claim 25, wherein said electrical valve means is activated when an electrical signal above a predetermined magnitude is provided.

* * * * *